US007573188B2

(12) United States Patent
Kang et al.

(10) Patent No.: US 7,573,188 B2
(45) Date of Patent: Aug. 11, 2009

(54) ELECTRON EMISSION DISPLAY

(75) Inventors: Jung-Ho Kang, Yongin-si (KR); Seung-Joon Yoo, Yongin-si (KR); Zin-Min Park, Yongin-si (KR); Su-Kyung Lee, Yongin-si (KR); Won-Il Lee, Yongin-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 319 days.

(21) Appl. No.: 11/689,996

(22) Filed: Mar. 22, 2007

(65) Prior Publication Data

US 2008/0122340 A1 May 29, 2008

(30) Foreign Application Priority Data

Apr. 20, 2006 (KR) ..... 10-2006-0035831

(51) Int. Cl.
*H01J 1/62* (2006.01)

(52) U.S. Cl. ..... 313/495

(58) Field of Classification Search ..... 313/495–496, 313/309, 336, 351
See application file for complete search history.

(56) References Cited

U.S. PATENT DOCUMENTS 6,621,232 B2 * 9/2003 Jo et al. ..... 315/169.3
7,176,614 B2 * 2/2007 Lee et al. ..... 313/496

* cited by examiner

*Primary Examiner*—Vip Patel
(74) *Attorney, Agent, or Firm*—Christie Parker & Hale LLP

(57) ABSTRACT

An electron emission display includes first and second substrates that face each other, a plurality of electron emission elements that are arrayed on the first substrate, phosphor and black layers that are formed on a surface of the second substrate, and an anode electrode that is formed of metal and located on surfaces of the phosphor and black layers. The anode electrode is formed to satisfy the following condition: 0.3 μm≦A≦3 μm where, A indicates a distance between the anode electrode and the phosphor layer.

6 Claims, 5 Drawing Sheets

ELECTRON EMISSION DISPLAY

CROSS-REFERENCE TO RELATED APPLICATION

This application claims priority to and the benefit of Korean Patent Application No. 2006-0035831 filed on Apr. 20, 2006 in the Korean Intellectual Property Office, the entire contents of which are incorporated herein by reference.

BACKGROUND OF THE INVENTION

1. Field of the Invention

The present invention relates to an electron emission display including an anode electrode having a light reflection function.

2. Description of Related Art

Although the different types of the electron emission elements differs in their electron emission principle and detailed structure, each of them basically includes an electron emission region and driving electrodes for controlling electron emission of the electron emission region.

A plurality of electron emission elements are arrayed on a first substrate to form an electron emission unit. A light emission unit having a phosphor layer, a black layer, and an anode electrode is formed on an opposite surface of the second substrate to the first substrate. The combination of the first and second substrates forms an electron emission display.

SUMMARY OF THE INVENTION

A metal layer formed of, for example, aluminum (Al) may be used as an anode electrode of the electron emission display. This metal anode electrode is formed to cover the phosphor layer and the black layer. The metal anode electrode heightens the screen luminance by reflecting visible light, which is emitted from the phosphor layer toward the first substrate, toward the second substrate.

The phosphor layer is formed by depositing phosphor particles each having a size of several μm and the anode electrode is formed to have a thickness of thousands Å considering an electron transmittance. Therefore, when the aluminum is directly deposited on the surface of the phosphor layer, the anode electrode is directly affected by a roughness of the phosphor particles the light reflection effect cannot be obtained. As a result, the screen luminance cannot be enhanced.

Accordingly, in order to solve the above problem, an interlayer that will be vaporized through a baking process is formed of a polymer material on the phosphor and black layers formed on the second substrate and metal (e.g., aluminum) is deposited on the interlayer. Then, the baking process is performed to remove the interlayer, thereby forming the anode electrode.

As the interlayer is removed, the anode electrode is spaced apart from the phosphor and black layers. At this point, a distance between the phosphor layer and the anode electrode significantly affects the light reflection efficiency of the anode electrode.

However, in the conventional electron emission display, since the distance between the phosphor layer and the anode electrode is not optimized, the light reflection efficiency of the anode electrode cannot be maximized. As a result, the conventional electron emission display has a limitation in increasing the screen luminance and the color reproduction rate due to the low light reflection efficiency.

Therefore, the present invention provides an electron emission display that can improve a screen luminance and color reproduction rate by enhancing the light reflection efficiency by optimizing a distance between the anode electrode and the phosphor layer.

In an exemplary embodiment of the present invention, an electron emission display includes first and second substrates that face each other, a plurality of electron emission elements that are arrayed on the first substrate, phosphor and black layers that are formed on a surface of the second substrate, and an anode electrode that is formed of metal and located on surfaces of the phosphor and black layers, wherein, the anode electrode is formed to satisfy the following condition:

$$0.3\ \mu m \leqq A \leqq 3\ \mu m$$

where, A indicates a distance between the anode electrode and the phosphor layers.

The anode electrode may be located to contact the black layer or spaced apart from the black layer by a distance ranging from 0.3 μm to 3 μm.

The anode electrode may be formed of a material selected from the group consisting of aluminum (Al), chrome (Cr), silver (Ag), titanium (Ti), and molybdenum (Mo) and have a thickness ranging from 100 Å to 2000 Å.

Each of the electron emission elements may be a Field Emitter Array type (FEA), a Metal-Insulator-Metal (MIM) type, a Metal-Insulator-Semiconductor (MIS) type, or a Surface Conduction Emitter (SCE) type.

DETAILED DESCRIPTION OF THE EMBODIMENTS

As those skilled in the art would realize, the described embodiments may be modified in various different ways, all without departing from the spirit or scope of the present invention. Wherever possible, the same reference numbers are used throughout the drawings to refer to the same or like parts.

Figure 1:
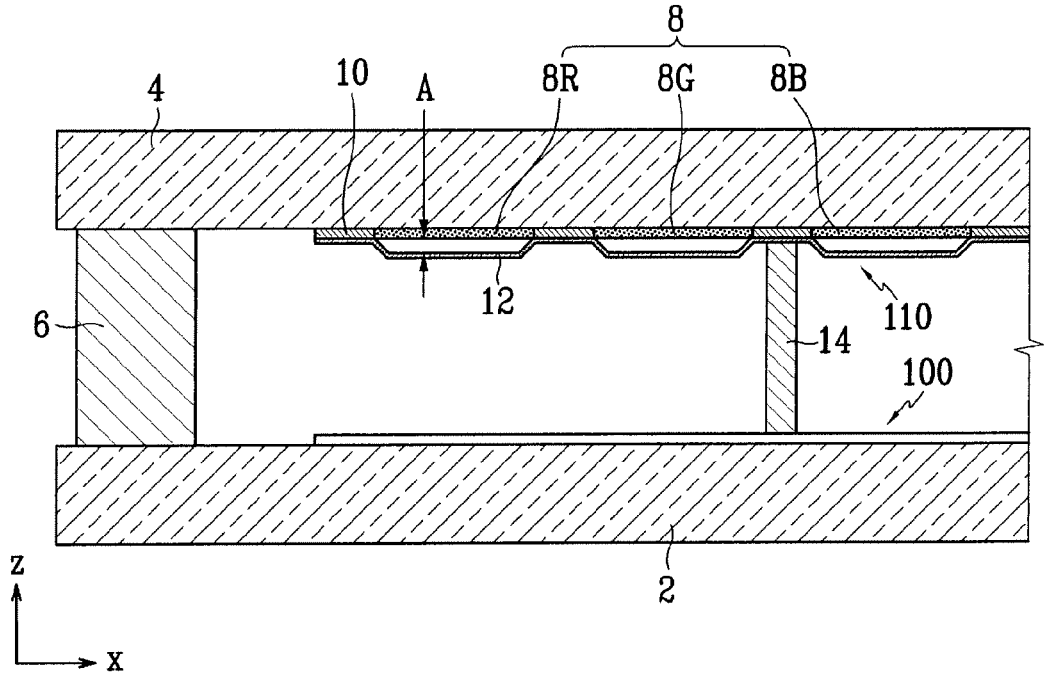
FIG. 1 is a sectional view of an electron emission display according to an exemplary embodiment of the present invention.

FIG. 1 is a schematic partial sectional view of an electron emission display according to an exemplary embodiment of the present invention.

Referring to FIG. 1, an electron emission display includes first and second substrates 2 and 4 facing each other in parallel and spaced apart from each other by a predetermined distance. A sealing member 6 is provided at the peripheries of the first and second substrates 2 and 4 to seal them together, thereby forming a vessel. In one embodiment, the interior of the vessel is exhausted to be kept to a degree of vacuum of about $10^{-6}$ Torr.

An electron emission unit 100 on which electron emission elements are arrayed is provided on a surface of the first substrate 2 facing the second substrate 4 and a light emission unit 110 including phosphor layers 8 and an anode electrode 12 is provided on a surface of the second substrate 4 facing the first substrate 2.

The electron emission elements of the electron emission unit 100 may be an FEA type, an SCE type, an MIM type, or an MIS type. The electron emission unit 100 includes electron emission regions and driving electrodes. The electron emission unit 100 emits the electrons for each pixel. By the emitted electrons, the phosphor layers of the corresponding pixels are excited to emit visible light. The intensity of the emitted visible light corresponds to an amount of the emitted electrons.

In more detail, phosphor layers 8, for example, red, green and blue phosphor layers 8R, 8G, 8B are formed on the second substrate 4 and spaced apart from each other by a predetermined distance. A black layer 10 for enhancing a screen contrast is formed between each of the phosphor layers 8. The phosphor layers 8 are arranged to correspond to the respective pixels.

An anode electrode 12 that is a metal layer formed of, for example, aluminum (Al) is formed on the phosphor layers 8. The anode electrode 12 is externally applied with a high voltage required for accelerating electron beams to maintain the phosphor layers 8 in a high electric potential state. The anode electrode 12 heightens the screen luminance by reflecting visible light, which is emitted from the phosphor layer toward the first substrate thereby enhancing the screen luminance.

Moreover, a transparent conductive layer (not shown) functioning as a sub-anode electrode may be formed on the surfaces of the phosphor and black layers 8 and 10 facing the first substrate 4. The transparent conductive layer may be formed of indium tin oxide (ITO).

Located between the first and second substrates 2 and 4 are spacers 14 for uniformly maintaining a gap between the first and second substrates 2 and 4 against the external force. The spacers 14 are arranged to correspond to the black layer 10 and do not overlap the phosphor layers 8. For convenience, only one spacer is illustrated in the drawing.

In the above-described structure, the anode electrode 12 is not formed by directly depositing a metal material on the phosphor layer 8. Rather, an interlayer (not shown) is first formed on the phosphor layer 8 and black layer 10 and a metal material is deposited on the interlayer. Then, the interlayer is vaporized through a baking process. Therefore, the anode electrode 12 is spaced apart from the phosphor and black layers 8 and 10 by a predetermined distance.

Alternatively, the interlayer may be provided only on the phosphor layers 8. In this case, the anode electrode 12 is formed to directly contact the black layer 10. This is illustrated In FIG. 1.

In the present exemplary embodiment, in order to increase the light reflection efficiency of the anode electrode 12, the distance between the anode electrode 12 and the phosphor layer 8 is optimized. That is, the anode electrode 12 of the present exemplary embodiment is formed to satisfy the following condition:

$$0.3\ \mu m \leqq A \leqq 3\ \mu m \qquad \text{Equation 1}$$

where, A indicates a distance between the anode electrode 12 and the phosphor layer 8.

Figure 2:
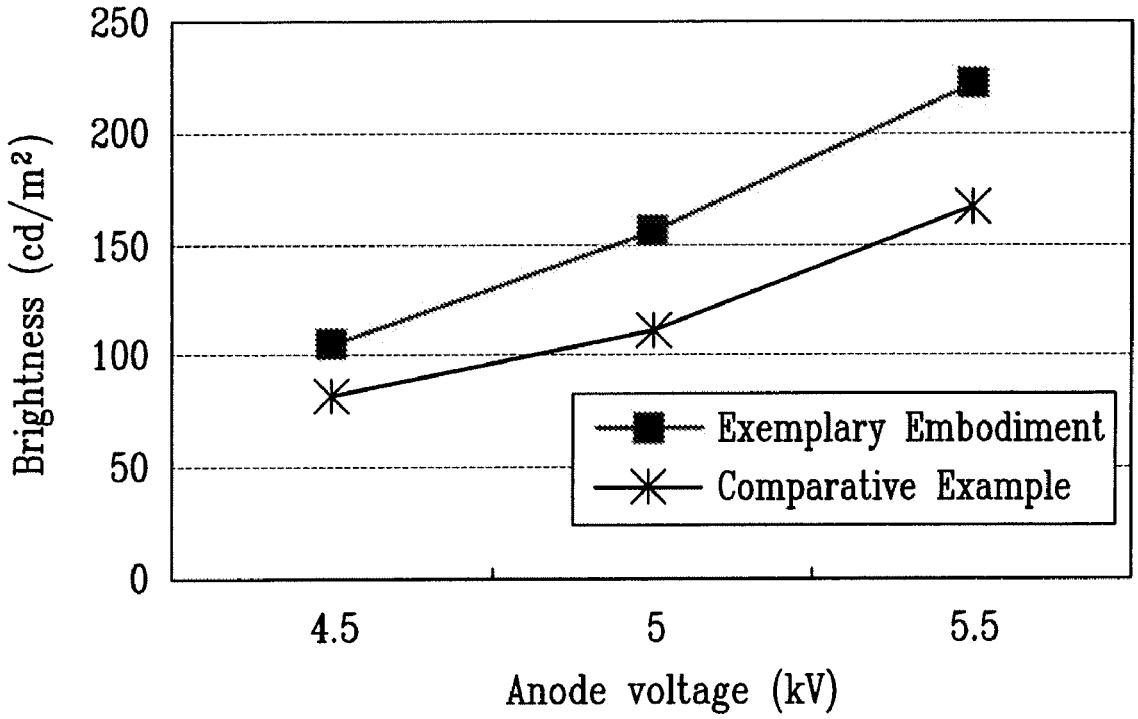
FIG. 2 is a graph illustrating the screen luminance of an electron emission display of an exemplary embodiment of the present invention and an electron emission display of a comparative example, according to an anode voltage.

FIG. 2 is an experimental graph illustrating a variation of the screen luminance (cd/m$^2$) according to a variation of the anode voltage (kv) in an electron emission display of an exemplary embodiment of the present invention where a distance between the anode electrode and the phosphor layer ranges from 0.3 μm to 3 μm and in an electron emission display of a comparative example where a distance between the anode electrode and the phosphor layer is less than 3 μm.

Referring to FIG. 2, it can be noted that the screen luminance of the electron emission display of the exemplary embodiment is higher than that of the electron emission display of the comparative example. This results from the fact that the anode electrode 12 of the exemplary embodiment more effectively reflects the light emitted from the phosphor layer as compared with the anode electrode of the comparative example.

When the distance between the phosphor layer 8 and the anode electrode 12 is greater than 3 μm, the anode electrode 12 may be easily broken due to the swelling of the interlayer during the manufacturing process of the light emission unit 110. Therefore, it is desirable that the distance between the phosphor layer 8 and the anode electrode 12 be equal to or less than 3 μm.

Accordingly, the anode electrode 12 satisfying the equation 1 maximizes the light reflecting efficiency, thereby increasing the screen luminance and the color reproduction rate. Furthermore, since the anode electrode 12 is spaced apart from the phosphor layers 8 so as not to damage the phosphor layers 8, the deterioration of the light emission efficiency due to the damage of the phosphor layers 8 can be prevented.

Meanwhile, if the interlayer 8 is formed between the anode electrode 12 and the black layer 10 so that the anode electrode 12 does not contact the black layer 10, the distance between the anode electrode 12 and the black layer 10 may be identical to that between the anode electrode 12 and the phosphor layers 8. That is, the distance between the anode electrode 12 and the black layer 10 may range from 0.3 μm to 3 μm.

The anode electrode 12 may be formed of, in addition to aluminum (Al), a metal material having a high level of light reflecting efficiency, such as chrome (Cr), silver (Ag), or molybdenum (Mo). A thickness of the anode electrode 12 may range from 100 Å to 2000 Å.

As described above, in the electron emission display according to the exemplary embodiment, since the light reflecting efficiency of the anode electrode increases, the display quality related to the screen luminance and the color reproduction rate can be improved.

The electron emission display may be classified according to a type of the electron emission element thereof such as an FEA type, an SCE type, an MIM type, or an MIS type.

An FEA type electron emission display having the anode electrode 12 satisfying the above-described condition will be described with reference to FIGS. 3 and 4. An SCE type electron emission display having the anode electrode 12 satisfying the above-described condition will be also described with reference to FIG. 5.

Figure 3:
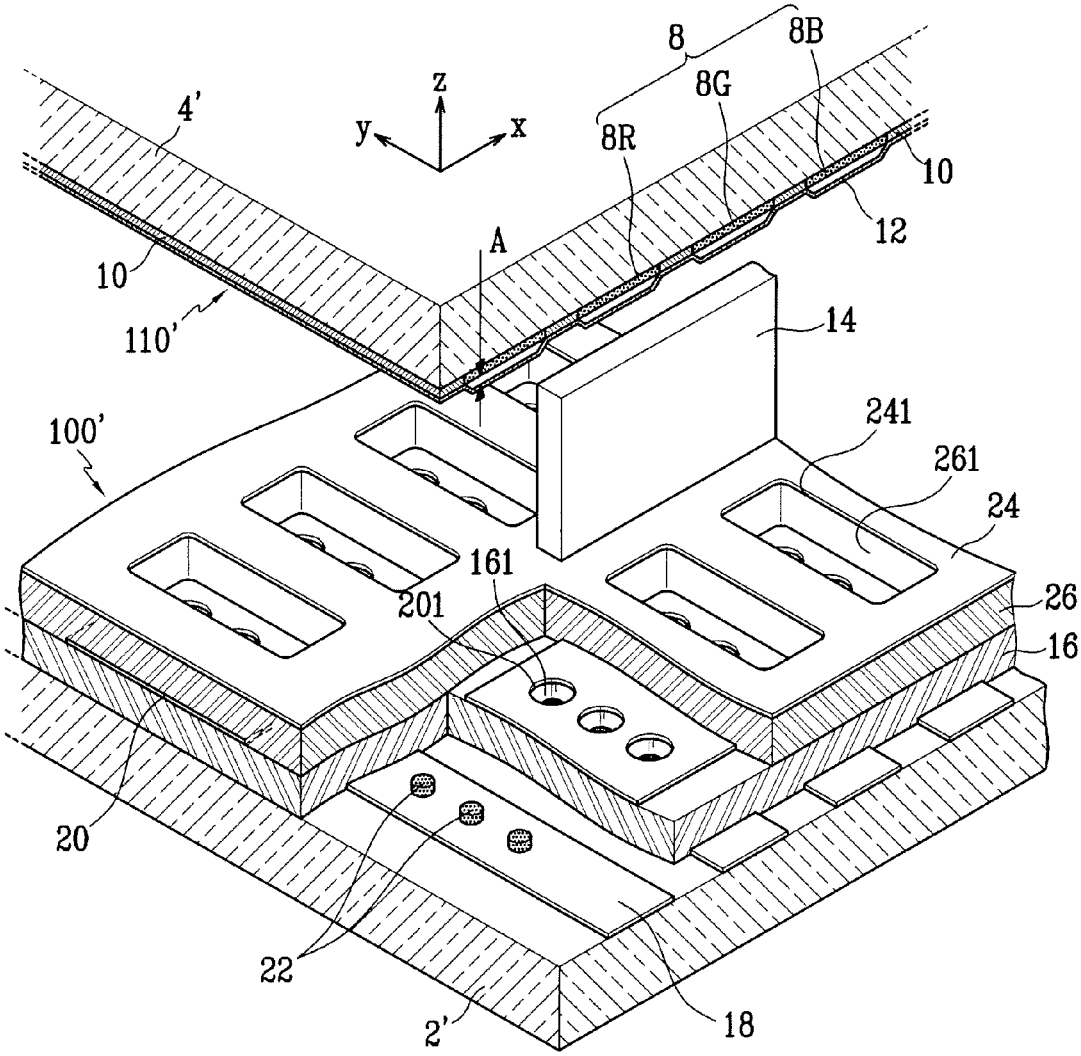
FIG. 3 is an exploded perspective view of an FEA type electron emission display according to an exemplary embodiment of the present invention.
Figure 4:
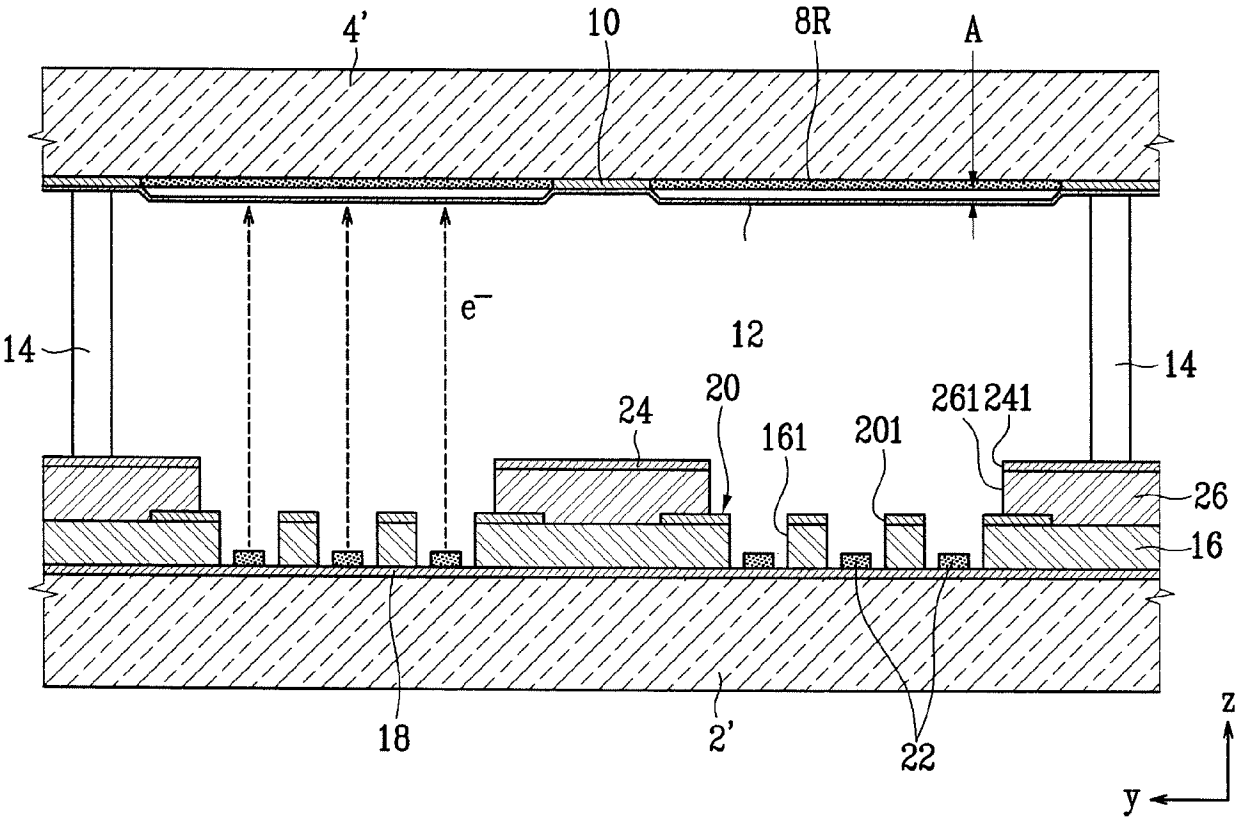
FIG. 4 is a partial sectional view of the FEA type electron emission display of FIG. 3.

Referring to FIGS. 3 and 4, an electron emission unit 100' includes a plurality of cathode electrodes 18 and a plurality of gate electrodes 20 crossing the cathode electrodes 18 at right angles with a first insulation layer 16 interposed between the cathode and gate electrodes 18 and 20.

When each crossed region of the cathode and gate electrodes 18 and 20 is defined as a pixel region, one or more electron emission regions 22 are formed on each pixel region.

First openings 161 and second openings 201 corresponding to the electron emission regions 22 are respectively formed in the first insulation layer 16 and the gate electrodes 20 to expose the electron emission regions 22 on a first substrate 2'.

The electron emission regions 22 may be formed of a material, which emits electrons when an electric field is applied thereto under a vacuum atmosphere, such as a carbonaceous material or a nanometer-sized material. For example, the electron emission regions 22 may be formed of carbon nanotubes, graphite, graphite nanofibers, diamonds, diamond-like carbon, $C_{60}$, silicon nanowires, or a combination thereof.

Alternatively, the electron emission regions 22 may be formed in a tip structure formed of a Mo-based or Si-based material.

A second insulation layer 26 is formed on the first insulation layer 16 and covers the gate electrodes 20. A focusing electrode 24 is formed on the second insulation layer 26. That is, the focusing electrode 24 is insulated from the gate electrodes 20 by the second insulation layer 26. Openings 241 and openings 261 through which electron beams pass are respectively formed in the focusing electrode 24 and the second insulation layer 26.

The openings 241 of the focusing electrode 24 may correspond to the respective electrode emission regions 22 to individually converge the electrons emitted from each electron emission region 22. Alternatively, the openings 241 of the focusing electrode 24 may correspond to the respective pixel regions to generally converge the electrons emitted from the electron emission regions 22 of each pixel region.

A light emission unit 110' provided on the second substrate 4' includes phosphor layers 8, a black layer 10, and an anode electrode 12 satisfying the Equation 1. Since the structure of the light emission unit 110' is identical to that of FIG. 1, a detailed description thereof will be omitted herein.

The FEA type electron emission display is driven when predetermined voltages are applied to the cathode, gate, focusing, and anode electrodes 18, 20, 24, and 12, respectively.

For example, one of the cathode and gate electrodes 18 and 20 functions as a scan electrode receiving a scan driving voltage and the other functions as a data electrode receiving a data driving voltage. The focusing electrode 24 receives a negative direct current voltage of 0 or several volts required for converging the electron beams. The anode electrode 12 receives a direct current voltage of, for example, hundreds through thousands volts that can accelerate the electron beams.

Electric fields are formed around the electron emission regions 22 at the unit pixels where a voltage difference between the cathode and gate electrodes 18 and 20 is equal to or higher than a threshold value and thus the electrons are emitted from the electron emission regions 22. The emitted electrons are converged to a central portion of a bundle of the electron beams while passing through the openings 241 of the focusing electrode 24 and strike the phosphor layers 8 of the corresponding pixel by the high voltage applied to the anode electrode 12, thereby exciting the phosphor layers 8 to realize an image.

Figure 5:
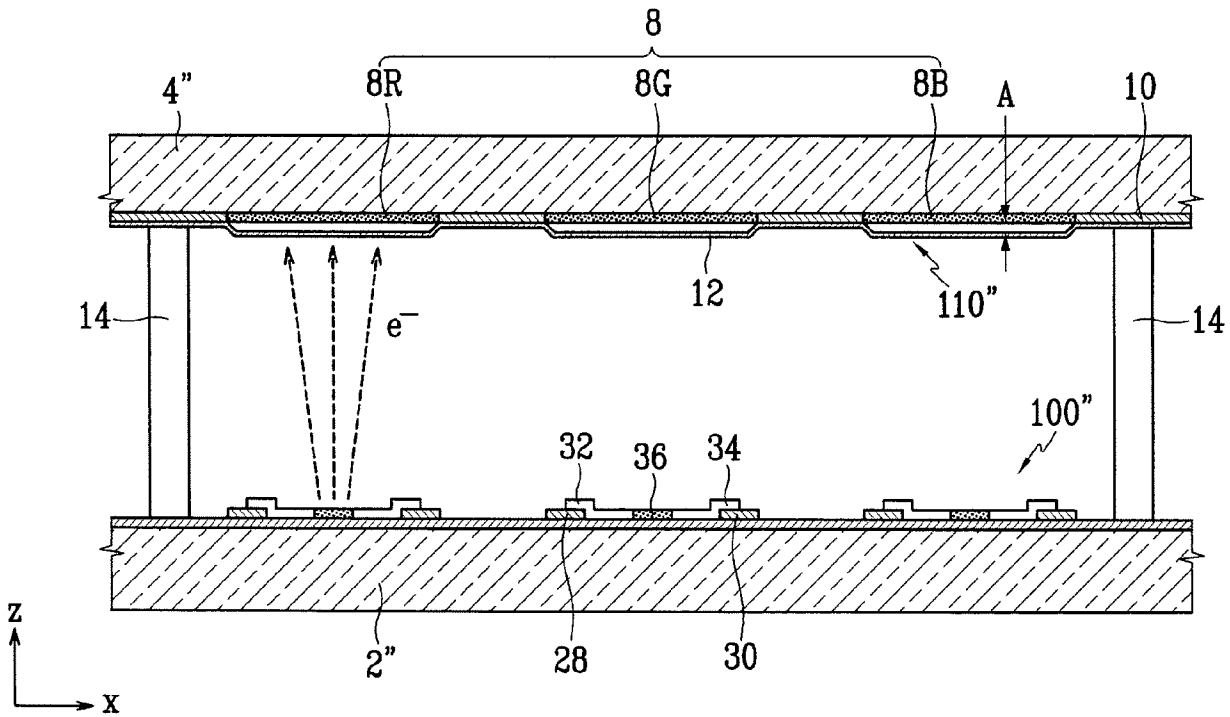
FIG. 5 is an exploded perspective view of an SCE type electron emission display according to an exemplary embodiment of the present invention.

Referring to FIG. 5, an SCE type electron emission display includes a first substrate 2", first and second electrodes 28 and 30 formed on the first substrate 2" and spaced apart from each other, first and second conductive layers 32 and 34 that are respectively formed on the first and second electrodes 28 and 30 and located in close proximate to each other, and electron emission regions 36 formed between the first and second conductive layers 32 and 34.

The first and second electrodes 28 and 30 may be formed of a variety of conductive materials. The first and second conductive layers 32 and 34 may be particle thin layers formed of nickel (Ni), gold (Au), platinum (Pt), or palladium (Pd). The electron emission regions 36 provided between the first and second conductive layers 32 and 34 may be fine-cracked or formed of graphite or carbon compound.

A light emission unit 110" is provided on the second substrate 4". The light emission unit 110" includes phosphor layers 8, a black layer 10, and an anode electrode 12. Since the structure of the light emission unit 110" is identical to that of FIG. 1, the detailed description thereof will be omitted herein.

When voltages are applied to the first and second electrodes 28 and 30, electric current flows in a direction that is level with surfaces of the electron emission regions 36 through the first and second conductive layers 32 and 34 and thus the electron emission regions 36 emit the electrons. The emitted electrons travel toward the second substrate 4" by the high voltage applied to the anode electrode 12 and strike the phosphor layers 8 of the corresponding pixel, thereby exciting the phosphor layers 8 to realize an image.

According to the electron emission display of the present invention, a distance between the phosphor layer and the anode electrode is optimized to improve the reflection efficiency of the anode electrode to prevent the phosphor layer due to the anode electrode, and improving the screen luminance and color production of the electron emission display.

Although exemplary embodiments of the present invention have been described in detail hereinabove, it should be clearly understood that many variations and/or modifications of the basic inventive concept taught herein still fall within the spirit and scope of the present invention, as defined by the appended claims and their equivalents.

What is claimed is:

1. An electron emission display comprising:

first and second substrates facing each other;

a plurality of electron emission elements arrayed on the first substrate;

phosphor and black layers that are formed on a surface of the second substrate facing the first substrate; and an anode electrode formed of metal and located on the phosphor and black layers, wherein, the anode electrode is located to satisfy the following condition:

$$0.3\ \mu m \leqq A \leqq 3\ \mu m$$

where, A indicates a distance between the anode electrode and the phosphor layer.

2. The electron emission display of claim 1, wherein the anode electrode is located to contact the black layer.

3. The electron emission device of claim 1, wherein a distance between the anode electrode and the black layer ranges from 0.3 μm to 3 μm.

4. The electron emission device of claim 1, wherein the anode electrode is formed of a material selected from the group consisting of aluminum (Al), chrome (Cr), silver (Ag), titanium (Ti), and molybdenum (Mo).

5. The electron emission device of claim 1, wherein the anode electrode has a thickness ranging from 100 Å to 2000 Å.

6. The electron emission device of claim 1, wherein each of the electron emission elements is one of a Field Emitter Array type, a Metal-Insulator-Metal type, a Metal-Insulator-Semiconductor type, and a Surface Conduction Emitter type.

* * * * *